US009515443B2

(12) United States Patent
Murris et al.

(10) Patent No.: US 9,515,443 B2
(45) Date of Patent: Dec. 6, 2016

(54) BRUSH HOLDER FOR AN ELECTRICAL SWIVEL

(75) Inventors: Eric Jean-Francois Rene Murris, Nice (FR); Gérard André Revol, Cagnes-sur-Mer (FR); Georges Roger Yves Dixneuf, Saint-Laurent-du-Var (FR)

(73) Assignee: Single Buoy Moorings Inc., Marly (CH)

( * ) Notice: Subject to any disclaimer, the term of this patent is extended or adjusted under 35 U.S.C. 154(b) by 552 days.

(21) Appl. No.: 13/698,286

(22) PCT Filed: May 25, 2011

(86) PCT No.: PCT/EP2011/058548

§ 371 (c)(1),
(2), (4) Date: Nov. 16, 2012

(87) PCT Pub. No.: WO2011/154255

PCT Pub. Date: Dec. 15, 2011

(65) Prior Publication Data

US 2013/0062992 A1 Mar. 14, 2013

(30) Foreign Application Priority Data

Jun. 8, 2010 (EP) ..... 101653038

(51) Int. Cl.
*H01R 39/00* (2006.01)
*H01R 39/38* (2006.01)
(Continued)

(52) U.S. Cl.
CPC ..... *H01R 39/64* (2013.01); *H01R 39/08* (2013.01); *H01R 13/6683* (2013.01);
(Continued)

(58) Field of Classification Search
CPC ..... H01R 39/00; H01R 39/08; H01R 39/38; H01R 39/383; H01R 39/381; H01R 39/41
(Continued)

(56) References Cited

U.S. PATENT DOCUMENTS 2,773,247 A 12/1956 Erhardt
2,820,207 A * 1/1958 Roy et al. ..... 439/22
(Continued)

FOREIGN PATENT DOCUMENTS

DE 102007019828 B3 10/2008
GB 984192 A 2/1965
(Continued)

OTHER PUBLICATIONS https://en.wikipedia.org/wiki/Opto-isolator, Jul. 2016.*
Tille, Daniel, "International Search Report" for PCT/EP2011/058548, as mailed Sep. 14, 2011, 4 pages.

*Primary Examiner* — Burton Mullins
(74) *Attorney, Agent, or Firm* — Winstead PC

(57) ABSTRACT

Brush holder for an electrical swivel, wherein the brush holder is provided with an electrically conductive body, provided with means for connecting the body to a feed line for electrical energy and provided with at least one recess for receiving a brush adapted to transfer electrical energy towards a connector, wherein the brush is connected to the body by means of an electric wire for the transfer of electrical energy from the body towards the brush and by means of a spring for allowing the brush to be pushed out of the recess and to protrude from the surface of the body adapted to face the connector and for urging the brush against the connector.

7 Claims, 6 Drawing Sheets

(51) Int. Cl.

| | |
|---|---|
| ***H01R 39/64*** | (2006.01) |
| ***H01R 39/08*** | (2006.01) |
| *H01R 39/41* | (2006.01) |
| *H01R 13/66* | (2006.01) |
| *H01R 39/58* | (2006.01) |

(52) U.S. Cl.
CPC ..... *H01R 39/383* (2013.01); *H01R 39/41* (2013.01); *H01R 39/58* (2013.01)

(58) Field of Classification Search
USPC ..... 310/231–233, 239, 245; 439/11, 13, 439/19–21, 23–25, 29
See application file for complete search history.

(56) References Cited

U.S. PATENT DOCUMENTS

| | | | | | |
|---|---|---|---|---|---|
| 3,910,309 | A | * | 10/1975 | Kaiser | 137/580 |
| 3,968,391 | A | * | 7/1976 | Blank | 310/240 |
| 4,039,237 | A | * | 8/1977 | Cullen et al. | 439/191 |
| 4,098,526 | A | * | 7/1978 | DuBois | 285/119 |
| 4,252,388 | A | | 2/1981 | Brady | |
| 4,294,500 | A | * | 10/1981 | Wilson | 439/26 |
| 4,366,404 | A | * | 12/1982 | Ziegler | 310/239 |
| 4,504,752 | A | * | 3/1985 | Iwaki et al. | 310/68 R |
| 4,567,414 | A | * | 1/1986 | Berings | 318/524 |
| 4,663,552 | A | * | 5/1987 | Ohmstedt | 310/246 |
| 6,069,341 | A | * | 5/2000 | Gage et al. | 219/201 |
| 6,731,039 | B2 | * | 5/2004 | Lohr et al. | 310/148 |
| 6,742,308 | B1 | * | 6/2004 | Johnstone et al. | 52/65 |
| 7,107,725 | B2 | * | 9/2006 | Johnstone et al. | 52/65 |
| 7,137,822 | B1 | * | 11/2006 | Longmire et al. | 439/24 |
| 7,806,708 | B2 | * | 10/2010 | Erstad | 439/204 |
| 8,403,679 | B2 | * | 3/2013 | Berard et al. | 439/24 |

FOREIGN PATENT DOCUMENTS

| | | | |
|---|---|---|---|
| JP | 59191454 | A | 10/1984 |
| SU | 612776 | A1 | 6/1978 |

* cited by examiner

BRUSH HOLDER FOR AN ELECTRICAL SWIVEL

The invention relates to a brush holder for an electrical swivel and more specifically to a box-type brush holder for several brushes for an electrical swivel.

INTRODUCTION

The invention relates to a brush holder, specifically adapted to be used in an electrical swivel. An electrical swivel is used in an off shore installation for the transfer of electricity between a first, geo-stationary element towards a further element which can weathervane around the first element.

Such an electrical swivel is known, for instance from, U.S. Pat. No. 7,137,822. This document describes a swivel that can be used to transfer electricity produced on a weathervaning FPSO towards a geostationary sub-sea power line. The known swivel comprises at least one connector in the form of a slip ring in combination with a conductor in the form of a brush holder provided with carbon brushes for allowing the transfer of electricity from the conductor towards the connector ring.

FIG. 1 shows a brush holder 100 for an electrical swivel according to the prior art. The brush holder 100 comprises four brushes in the form of brush blocks 140, each for the transfer of electrical energy which is fed via feed line 130 towards a connector 120.

The brush holder 100 comprises an arm 110 which on both ends is provided with a clamp 111, 112, each with a first 113 and second 114 frame to receive a brush block 140. Each frame 113, 114 is provided with a spring 141 to urge the brush block 140 against the exterior of the connector 120.

A first problem that occurs with the brush holder 100 according to FIG. 1 is the fact that the transfer of electricity from the feed line 130 until the brush block 140 encounters several locations wherein proper electrical contact could proof to be difficult. The feed line is connected by means of fixing means, including a bolt 150, to a lip 151. This lip 151 is connected to the arm 110 by means of welds. The presence of the welds is a first potential obstacle for proper transfer of electricity.

The arm 110 is at its ends connected to the clamps 111, 112 by means of further bolts 152, 153. This connection of the arm 110 to the clamps 111, 112 is a further potential obstacle for proper transfer of electricity in the direction of the brush blocks 140.

A further, related problem is the fact that it is likely to have a difference in the electrical resistance between the arm 110 and the clamp 111 at the one end and the arm and the clamp 112 at the other end. This difference in resistance may lead to unwanted and unequal distribution of electricity in the direction of the brush blocks 140.

A further problem related to the use of the brush block 100 is the relative long distance between the brush blocks 140 at opposite ends of the brush holder 100, as will be explained with reference to FIGS. 2 and 3.

FIG. 2 shows schematically the transfer of electricity from a feed line 130, via a brush holder 100 towards a connector 120 and an outlet 160, wherein the brush holder 100 and the connector 120 are in a first position. The feed line 130 will transfer the electricity to the brush holder 100. The several brushes 140 of the brush holder 100 will contact the connector 120 and transfer the electricity to the connector 120 in order to allow the electricity to be transferred in the direction of the outlet 160.

In the position according to FIG. 2 the electrical resistance of the connector 120 will be similar for electricity which will flow from the brush holder 100 towards the outlet 160 via either path A or path B.

However, the situation will be very different in the situation shown in FIG. 3. According to FIG. 3 the transfer of electricity from the brush holder 100 to the connector 120 is at a position which will cause the electrical resistance of the path A' to be much less then the electrical resistance via the path B'. Because of the difference in electrical resistance between the path A' and B' in combination with the relative long distance between the brushes 140 at opposite ends of the brush holder 100, the majority of the electrical energy will be transferred from the brush holder 100 to the connector 120 by means of the brushes 140 which are closest to the outlet 160.

This means that the transfer of electricity from the brush holder 100 to the connector will not evenly be distributed over the several brushes 140, but on the contrary will be concentrated in only few of the brushes 140. This will lead to local heating of the brushes 140 (also known under the name hot spots) and this may deteriorate the functioning of the device in the long run.

The object of the invention is to provide a brush holder for an electrical swivel and an electrical swivel provided with such a brush holder which can avoid at least some of the problems related to the installation, use and maintenance of brush holders for electrical swivels according to the prior art.

SHORT DESCRIPTION OF THE INVENTION

According to a first aspect of the invention, the invention relates to a brush holder for an electrical swivel, wherein the brush holder is provided with an electrically conductive body, provided with means for connecting the body to a feed line for electrical energy and provided with at least one recess for receiving a brush adapted to transfer electrical energy towards a connector, wherein the brush is connected to the body by means of an electric wire for the transfer of electrical energy from the body towards the brush and by means of a spring for allowing the brush to be pushed out of the recess and to protrude from the surface of the body adapted to face the connector and for urging the brush against the connector.

In the present text the wording 'electrical swivel' is used for a device provided with a at least one combination of a brush holder, provided with at least one brush and a connector in the form of a connector ring to which the brush is connected, wherein the electrical swivel is used to transfer electricity from a stationary feed line towards a stationary brush holder and via the at least one brush of the brush holder towards a connector ring and outlet for electrical energy connected to the connector ring, wherein the connector ring is adapted to rotate with respect to the brush holder.

According to the invention several brushes will be encapsulated close together in a cassette or housing. This enables a much more compact swivel design with fewer components.

The brush holder according to the invention will allow a safer design and use, with less danger of short circuits, easier installation, change out and maintenance due to a modular structure and the device will avoid sparks and hot spots within the electrical swivel.

According to a preferred embodiment of the invention the at least one brush has the form of a brush block.

According to a preferred embodiment of the invention the brush holder is provided with a series of brushes, wherein the brushes are positioned in order to allow the protruding surfaces of the brushes to contact a connector in the form of a ring.

According to a preferred embodiment of the invention the brush holder is provided with a cover for covering the recesses the brushes received in the recesses.

According to a preferred embodiment of the invention the brush holder comprises a first series of brushes positioned above a second series of brushes.

According to a preferred embodiment, the brush holder comprises a temperature probe adapted to give, in real time, the brush temperature during operation.

According to a preferred embodiment, the temperature probe has the form of an optical temperature probe.

According to a second aspect of the invention, the invention relates to an electrical swivel provided with the brush holder according to the invention.

SHORT DESCRIPTION OF THE DRAWINGS

The invention will be better understood after the following description with reference to the accompanying drawings wherein.

Figure 6A:
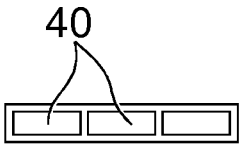
Figure 6B:
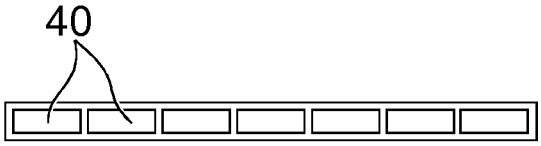
Figure 6C:
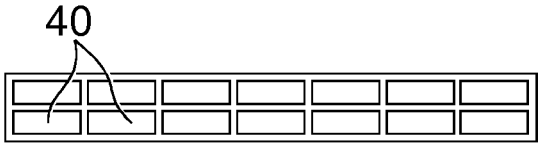
Figure 7:
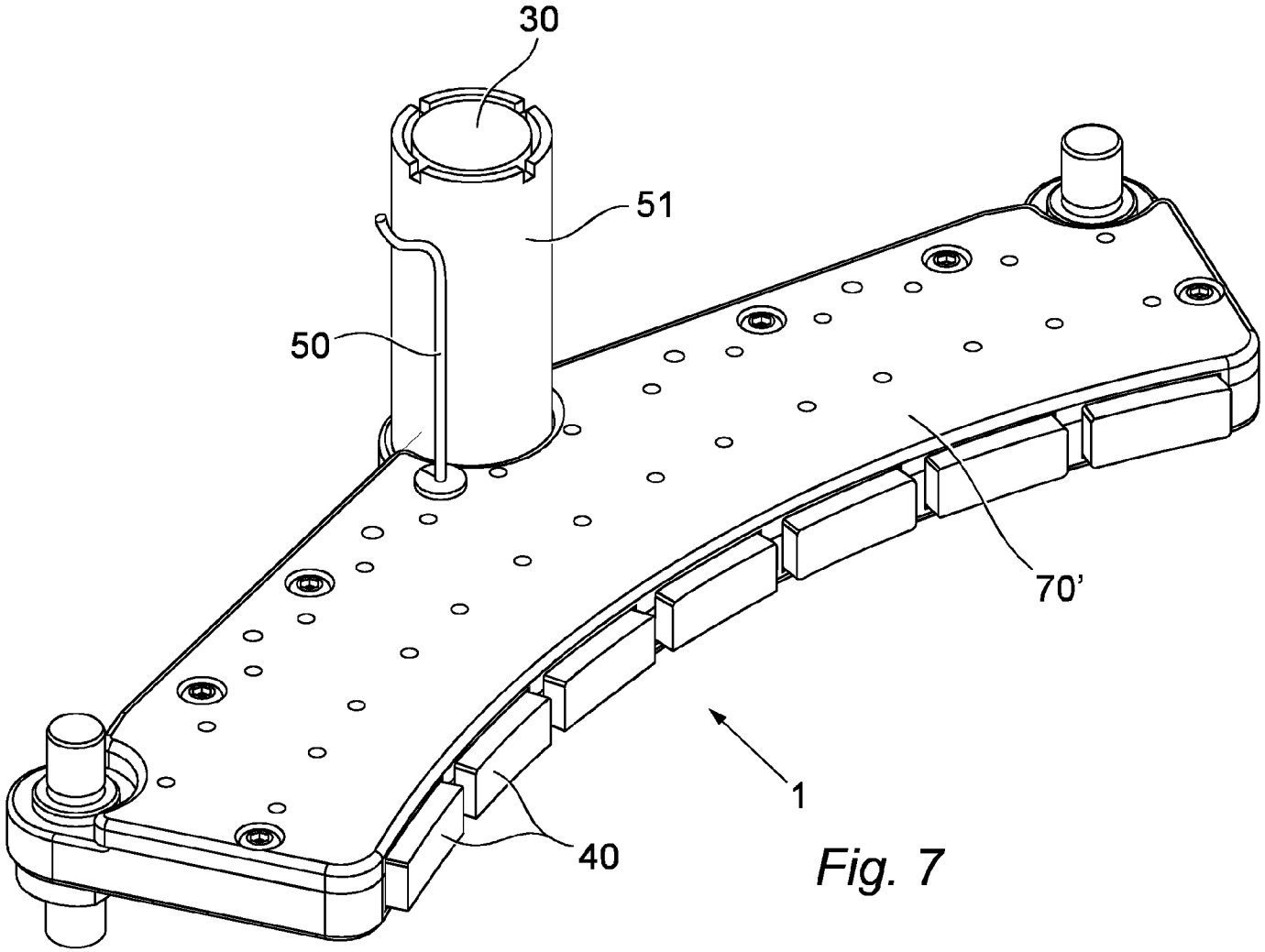

FIGS. 6*a*, 6*b*, and 6*c* schematically show three different embodiments for the brush holder according to the present invention, and FIG. 7 shows a second embodiment of the brush holder according to the invention

DETAILED DESCRIPTION OF THE INVENTION

Figure 3:
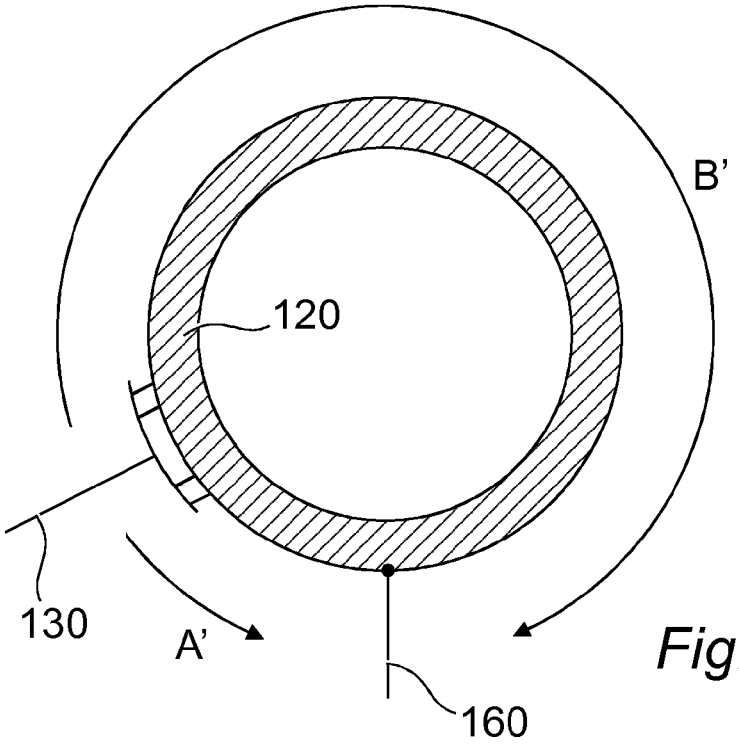
FIG. 3 shows schematically the transfer of electricity from a brush holder according to the prior art to a connector in a second position.
Figure 4:
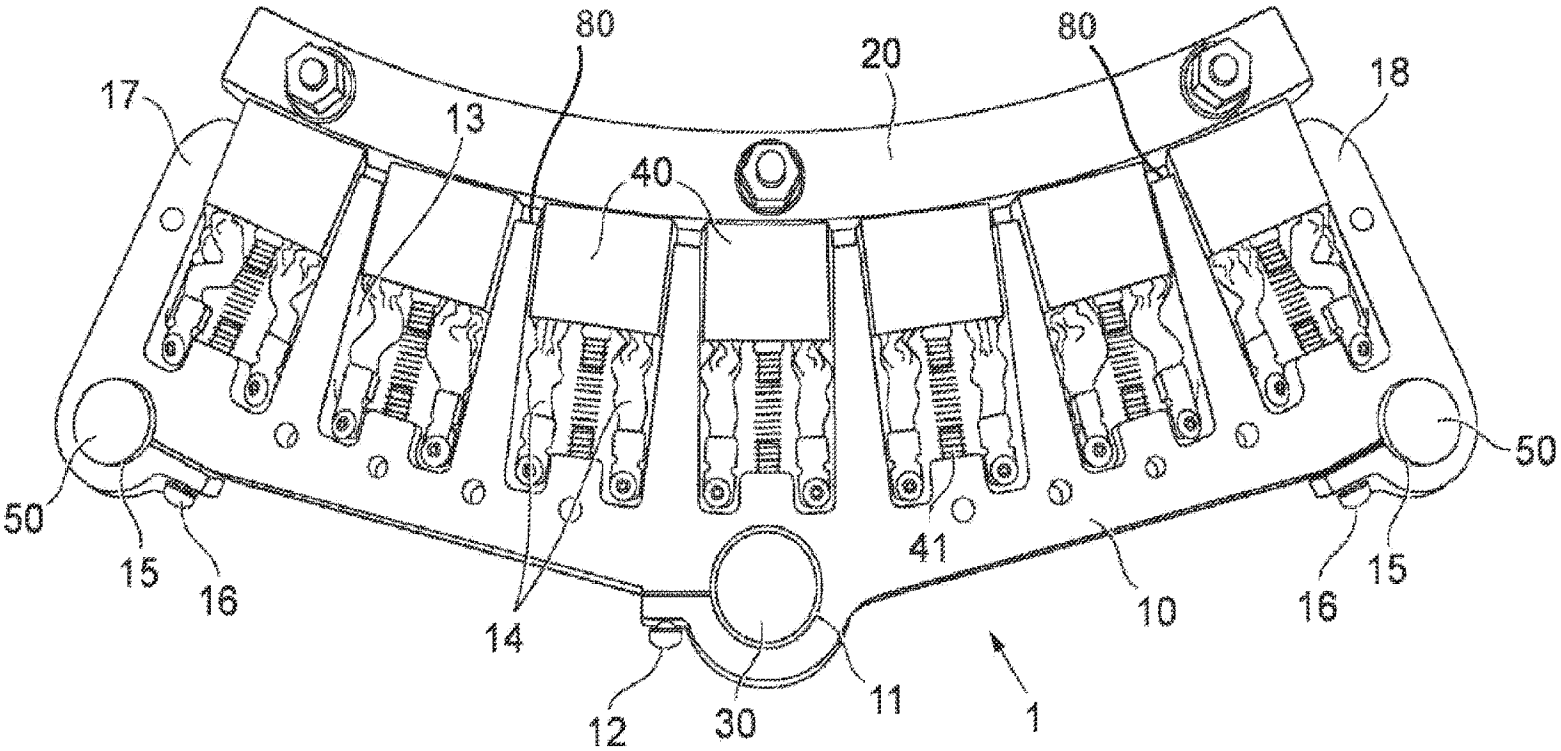
FIG. 4 shows in a top view the brush holder according to the invention, without the cover to show the interior.

FIG. 4 shows in a top view a first embodiment of a brush holder 1 according to the invention, without the cover to show the interior of the brush holder 1. The brush holder 1 is adapted to transfer electricity from a feed line 30 towards a connector 20. The connector 20 normally has the form of a ring. In FIG. 3 only a small portion of the ring forming the connector 20 is shown.

The brush holder 1 is provided with a body 10 from electrical conductive material, such as copper. The body 10 could be formed from a massive copper plate.

The body 10 of the brush holder 1 is provided with integral connecting means in the form of an opening 11 for receiving the feed line 30. Proper electrical contact is obtained by urging the body 10 and the feed line 30 to each other by means of bolt 12.

The body 10 is provided with a series of recesses 13, each adapted to receive a brush in the form of a brush block 40. According to embodiment of FIG. 4, seven recesses 13 are shown, which are adapted to receive seven brush blocks 40.

In order to connect the brush blocks 40 to the body 10, shunts 14 are used. For optimal electrical contact, each brush block 40 is connected by means of four shunts 14 to the body 10. In FIG. 4 per brush block 40, only two shunts 14 are clearly visible.

The brush blocks 40 are also connected to the body 10 by means of springs 41. These springs 41 are used to allow the brushes 40 to protrude from the surface 80 of the body 10 which is adapted to face the connector 20 and to urge the brushes 40 against the exterior of the connector 20 in order to assure proper electrical contact between the brushes 40 and the connector 20.

This force could be in the range of 50-60 Newton, preferably 53 Newton.

The body 10 is provided with two further openings 15, to receive fixing notches 50. The brush block 1 is fixed at an appropriate distance with respect to the connector 20 by fixing the body 10 on the two notches 50 by means of bolts 16.

When installing the brush holder 1 the gap between the connector ring 20 and the brush holder 1 is typically in the range of a comfortable 8 mm. This allows the assembly to be easy and without the need of very high precision. The advantage hereof is cost saving.

Once the brush block 1 is properly fixed next to the connector 20 the electrical energy can by transferred towards the connector 20: from the feed line 30 towards the body 10; from the body 10, via the shunts 14 towards the brush blocks 40; and from the brush blocks 40, which are biased by means of the springs 41, towards the connector 20.

The brush holder 1 according to FIG. 4 will be fixed in a certain position. The connector 20 will rotatably fixed in order to allow the surface of the connector 20 to move with respect to the brushes 40. If the connector moves in a clockwise direction (see FIG. 4) the brush blocks 40 will be pushed against the wall of the recesses 13 at the left hand side (see FIG. 4). If the connector 20 is rotated to move in the opposite direction, similarly the brush blocks 40 will be urged against the opposite walls of the recesses 13. The walls of the recesses 13 can help to transfer electricity towards the brush blocks 40.

The brush holder 1 according to FIG. 4 has a limited number of components. The main components are the body 10, the brushes 40 and the shunts 14 and the springs 41 to connect the two together.

The brush holder 1 according to FIG. 4 is very compact. The design of the brush holder 1 allows the brush holder 1 to have a large number of brush blocks 40 properly positioned in the device while having limited outside dimensions. The distance between the brush blocks 40 near the first extremity 17 of the brush holder 1 (left hand side of FIG. 4) and the brush 40 near the second extremity 18 of the brush holder 1 (right hand side of FIG. 4) is relatively limited. That means that the difference between the electrical resistance for the transfer of electricity transferred by the brush block 40 near the first extremity 17 and the brush block 40 near the second extremity 18 is also very limited. This allows the transfer of electricity to be evenly distributed over the different brush blocks 40.

Figure 1:
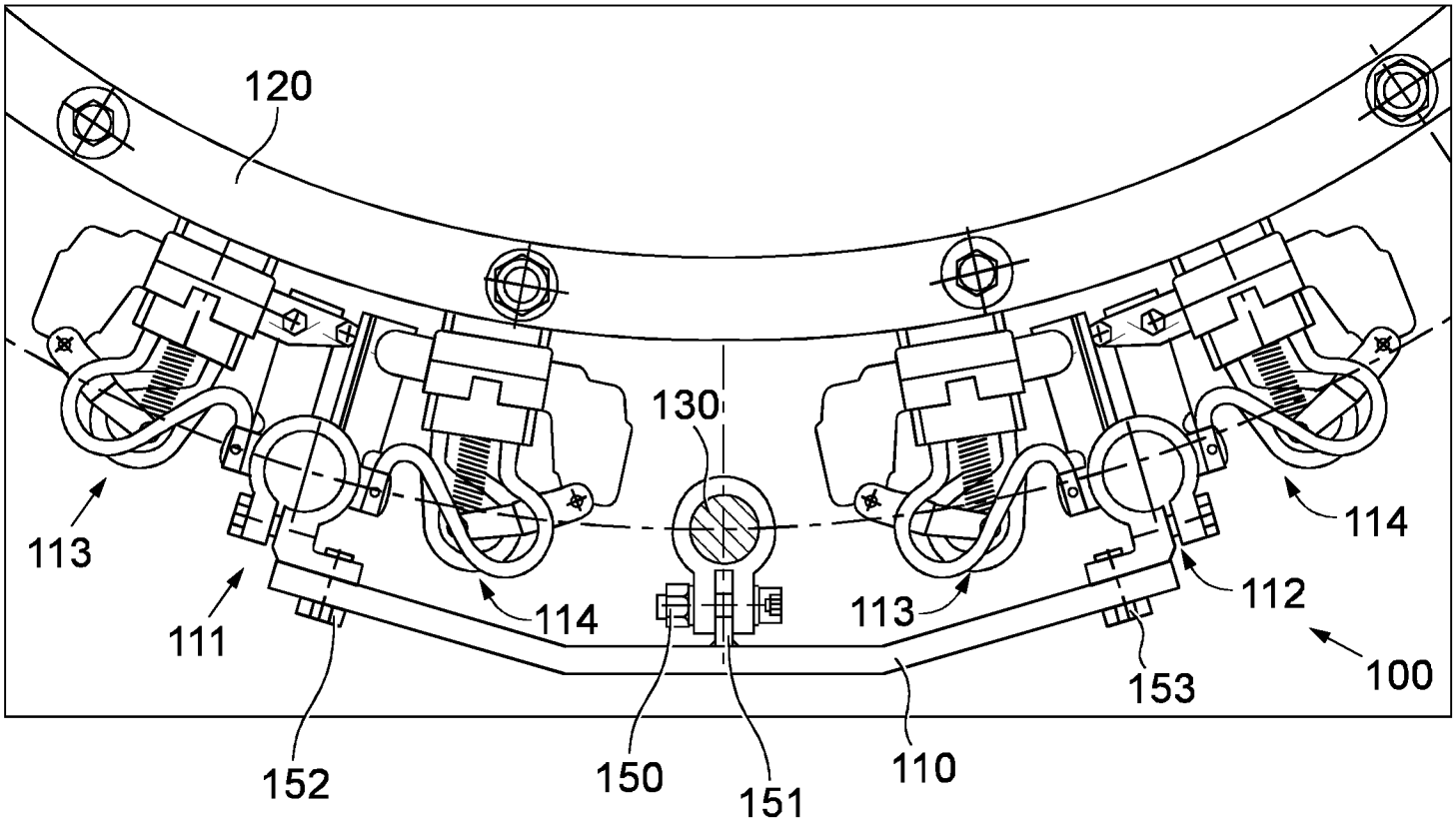
Fig. 1 (Prior Art)
FIG. 1 shows a brush holder for an electrical swivel according to the prior art.
Figure 2:
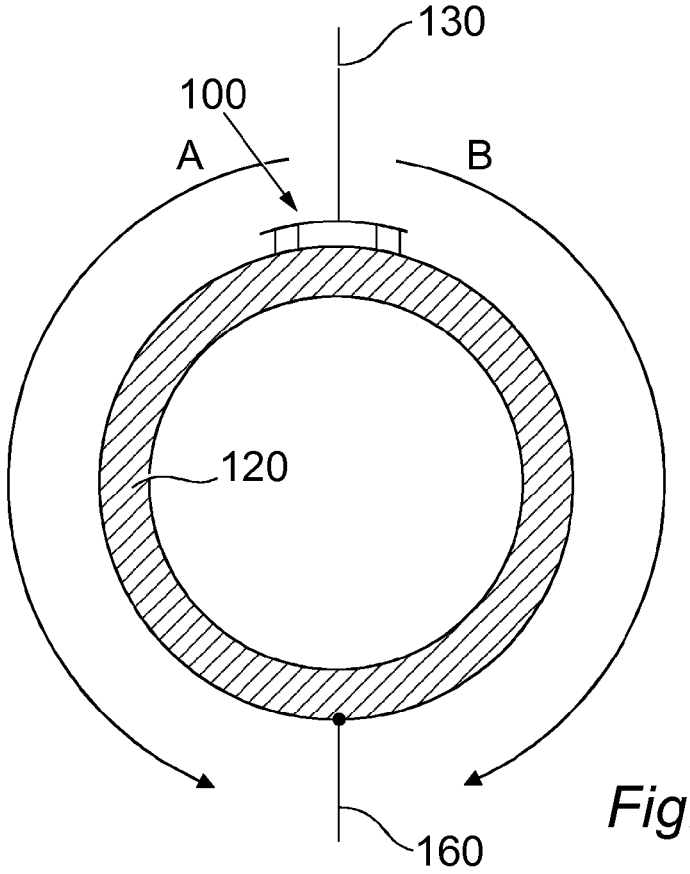
FIG. 2 shows schematically the transfer of electricity from a brush holder according to the prior art to a connector in a first position.

In other words, the amperage distribution is homogeneous due to the compactness of the brush holder 1. The brush holder 1 allows more surfaces of the brushes 40 to be in contact in a shorter area of the connector 2, then the devices according to the prior art (see FIG. 1). This will allow one supply entrance for electrical energy and this will give more possibilities to increase the number of paths inside an electrical swivel.

Moreover, the brush holder 1 gives more short circuit acceptance due to the increasing surface of the brush holder section. The constant force of the brushes 40 on the connector 20 is guaranteed; even during high short circuit level which will generate high temperature, shocks, and mechanical deformations.

The design of brush holder 1 according to FIG. 4 is applicable to both a Low Voltage (600 A) swivel and High Voltage swivel.

Figure 5:
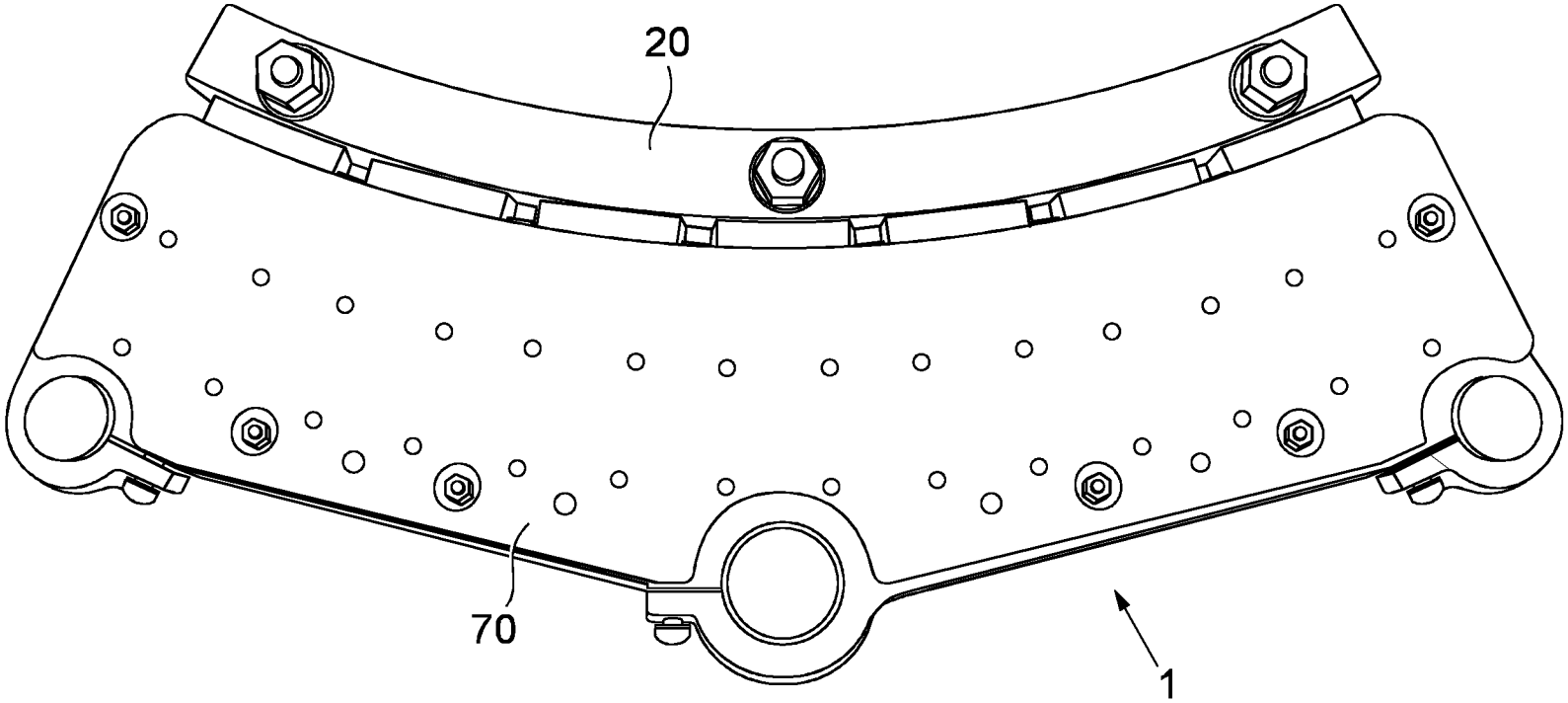
FIG. 5 shows the brush holder according to the invention, with the cover.

FIG. 5 shows the brush holder 1 according to FIG. 4, provided with a cover 70. FIG. 5 clearly shows that the brush holder 1 according to the invention provides a very smooth design having a structure in the form of a module or cassette. This module encapsulates all the brush blocks 40 and strap- or shunt connections. The cassette's smooth design assurances less electro field effect due to high voltage, and no arcing.

The module also provides advantages when assembling the electrical swivel. The module can be put into place in one single operation. The module can be filled with oil in order to allow the device to be insulated in oil during operation. Also in case of maintenance, the module can be removed and replaced in a very time efficient manner. The device 1 guarantees the encapsulation of all components and will avoid looses of parts during a possible violent external short circuit fault.

One of the other advantages of having a very compact brush holder is the fact that more rings can be stacked in an electrical swivel, offering more paths in lower height. That means that it is possible to install more connectors 20 due to the compactness of the brush holder 20.

In FIGS. 6*a*, 6*b*, and 6*c* schematically three different embodiments for the brush holder according to the present invention are shown.

According to FIG. 6*a* the brush holder 1 comprises three brushes 40.

According to FIG. 6*b* the brush holder 1 comprises seven brushes 40. This embodiment corresponds with the embodiment according to FIGS. 4 and 5.

According to FIG. 6*c* the brush holder 1 comprises fourteen brushes 40. In order to keep the brush holder compact, the second layer of brushes 40 is positioned above a first layer of brushes 40.

Other alternatives are possible, wherein for instance three or more layers of brushes are used.

EXAMPLES

The brush holder 1 according to the invention could be used in the following versions:

I: A Brush Holder Having 7 Block Brushes (See FIG. 6*b*)
Characteristics:
- Voltage rating up to 52 kV continuous
- Amperage rating up to 1000 A continuous
- Short circuit rating is 20 kA R.M.S.—1 sec—50 kA peak
- Power rating max per phase is 72 MegaWatts in three-phases
- Power rating max per phase is 59 MegaWatts in two-phases II: Brush Holder Having 14 Block Brushes (See FIG. 6*c*)
Characteristics:
- Voltage rating up to 52 kV continuous
- Amperage rating up to 3000 A continuous
- Short circuit rating is 36 kA R.M.S.—1 sec—90 kA peak
- Power rating max per phase is 140 MegaWatts in three-phases
- Power rating max per phase is 117 MegaWatts in two-phases III: Brush Holder Having 3 Block Brushes (See FIG. 6*a*)
Characteristics:
- Voltage rating up to 52 kV continuous
- Amperage rating up to 450 A continuous
- Short circuit rating is 7.5 kA R.M.S.—1 sec—18.75 kA peak
- Power rating max per phase is 36 MegaWatts in three-phases
- Power rating max per phase is 29 MegaWatts in two-phases Optional Design IV: Brush Holder Having 4 Block Brushes
Characteristics:
- Voltage rating up to 52 kV continuous
- Amperage rating up to 600 A continuous
- Short circuit rating is 10 kA R.M.S.—1 sec—25 kA peak
- Power rating max per phase is 43 MegaWatts in three-phases
- Power rating max per phase is 35 MegaWatts in two-phases In FIG. 7, a second embodiment of the brush holder l' is shown wherein the brush holder l' is closed off with a cover 70'. The brush holder l', according to FIG. 7, is provided with seven brushes 40. The brush holder l', according to FIG. 7, is also equipped with a temperature prop 50. This temperature prop is, for instance, an optical temperature prop adapted to give, in real time, of the brush temperature. The addition of this temperature prop 50 is especially important for security reasons during high voltage (for instance in the region of 120 kV to 300kV) and very high amperage operations.

The temperature prop 50 can be used for monitoring of the temperature of the brush holder 1' wherein a change in temperature of the brush holder 1' indicates if there is a contact deficiency between brushes 40 and a contact ring 20 with which the brushes 40 are in contact. The presence of a temperature prop will add an additional safety feature to the brush holder 1'.

FIG. 7 also shows the presence of an insulation 51 around the feet line 30 in order to provide additional protection during high voltage and very high amperage operations.

The invention claimed is:

1. A brush holder for an electrical swivel, wherein the brush holder is provided with an electrically conductive replaceable cassette plate, provided with means for connecting the replaceable cassette plate to a cylindrical feed line for electrical energy, provided with an opening for receiving the feed line, and provided with a plurality of recesses in a lateral surface of the replaceable cassette plate, each recess of the plurality of recesses for receiving a brush adapted to transfer electrical energy towards an annular connector, wherein the brush is connected to the replaceable cassette plate by means of an electric wire for transfer of electrical energy from the replaceable cassette plate towards the brush and by means of a spring for allowing the brush to be pushed out of an opening in the recess and to protrude from a front surface of the replaceable cassette plate that is perpendicular to the lateral plate surface and is adapted to face the annular connector and for urging the brush against the annular connector, and in which, in each recess, the brush and an electrical wire connection to the replaceable cassette plate are encapsulated, and an edge of the front surface of the replaceable cassette plate that is perpendicular to a plate surface and is adapted to interface with the annular connector, is shaped as a curved segment along the annular connector, and the brushes are positioned adjacent to each other along the curved segment separated by intermediate electrically conductive recess walls in the replaceable cassette plate.

2. The brush holder according to claim 1, wherein at least one brush has a form of a block.

3. The brush holder according to claim 1, wherein the brush holder is provided a series of brushes, wherein the series of brushes are positioned in order to allow protruding surfaces of the series of brushes to contact a connector in a form of a ring.

4. The brush holder according to claim 1, wherein the brush holder comprises a first series of brushes positioned above a second series of brushes.

5. The brush holder according to claim 1, wherein the brush holder comprises a temperature probe to give the temperature of the brush holder during operation.

6. The brush holder according to claim 5, wherein the temperature probe is an optical temperature probe.

7. An electrical swivel provided with the brush holder according to claim 1.

* * * * *